United States Patent [19]

Schiecke

[11] 4,050,041

[45] Sept. 20, 1977

[54] STATIC/PURITY DEVICE FOR IN-LINE GUN

[75] Inventor: Konrad L. Schiecke, Mount Prospect, Ill.

[73] Assignee: Zenith Radio Corporation, Glenview, Ill.

[21] Appl. No.: 672,693

[22] Filed: Apr. 1, 1976

[51] Int. Cl.[2] ..... H01J 29/82

[52] U.S. Cl. ..... 335/210

[58] Field of Search ..... 313/412, 413, 421, 425, 313/433, 438, 482; 335/210, 212

[56] References Cited

U.S. PATENT DOCUMENTS

| | | | |
|---|---|---|---|
| 3,410,955 | 11/1968 | Mackey | 335/212 X |
| 3,525,962 | 8/1970 | Javorik | 335/210 |

*Primary Examiner*—A. D. Pellinen

*Attorney, Agent, or Firm*—Nicholas A. Camasto

[57] ABSTRACT

A static/purity device includes a stationary bipolar purity control with rotatable magnets and movable quadipolar and sextipolar controls with rotatablemagnets for positioning over an in-line arrangement of electron guns in a color television picture tube. The picture tube base defines a reference surface for the guns. The picture tube socket is mounted on a component-carrying printed circuit board which fits around the neck of the picture tube with the socket abutting the reference surface. A rigid plastic insulating cover protects the foil side of the board. The static/purity device includes a pair of legs cooperating with apertures in the cover for correctly positioning the magnets with respect to the gun elements when the socket is connected to the tube base. A clamp firmly affixes the entire assembly to the picture tube neck.

6 Claims, 2 Drawing Figures

STATIC/PURITY DEVICE FOR IN-LINE GUN

CROSS REFERENCE TO RELATED PATENT APPLICATION

This application discloses apparatus described and claimed in copending application Ser. No. 650,472, filed Jan. 19, 1976, abandoned Dec. 14, 1976, in the names of Konrad L. Schiecke and Joseph M. VanBaalen, entitled "BASE-SOCKET SYSTEM FOR A COLOR TELEVISION PICTURE TUBE", and assigned to Zenith Radio Corporation.

BACKGROUND OF THE INVENTION

This invention relates to convergence apparatus for color television picture tubes and particularly to such apparatus for color television picture tubes having a plurality of electron guns arranged in a single plane, commonly referred to as "in-line" gun structure.

Color television receivers employing picture tubes of the multi-gun type have been known for many years. The most popular has been the three gun shadow mask tube in which three triangularly-disposed-electron-emitting guns, located in the neck of the picture tube, produce respective streams of electrons directed toward a target consisting of a mosaic of different colored-light-emitting phosphor deposits on the inner surface of the transparent picture tube face. A perforate shadow mask is mounted close to the screen and shields the phosphor elements from electrons emanating from any but their associated one of the electron guns. Conventional deflection apparatus vertically and horizontally scan the electron beams across the phosphor target.

Because of the different attitudes of the electron beam paths in the yoke deflection field, tolerances in gun and tube manufacture and because the guns are not located at the center of curvature of the screen, various misconvergence and purity errors occur. Static errors, that is, errors in the center of the tube under free fall (no deflection) conditions may be corrected with the help of external magnets and properly designed gun elements. Dynamic errors occur during deflection of the beams. Some of these errors may be compensated in the yoke design. In general, however, both static and dynamic beam correction devices are used to maintain the electron beams in correct relationship with respect to the picture tube mask and phosphor deposits. Many of these problems may be minimized by adjusting the design of the mask and phosphor mosaic target of the picture tube to the yoke.

Recently the in-line gun type of picture tube has become popular. In this tube the three electron guns are aligned in a horizontal plane. When used in conjunction with a vertically striped phosphor screen and a shadow mask with vertical slots, the problems of dynamic convergence of the beams are greatly simplified. Indeed, such a simplification is possible that the expensive and cumbersome dynamic convergence circuitry (required for delta gun arrangements) may be obviated. There are such tubes currently available which have yokes permanently cemented in place and which do not need dynamic convergence.

Further developments have been directed toward achieving better gun performance especially in the area of spot size, which is perceived by the viewer as sharper focus. One recently introduced electron gun arrangement uses extra elements for developing electron beams having desirable spot size characteristics under a wide range of beam intensities. It is referred to as an extended focus lens (EFL) gun and has one or more relatively high potential focusing elements, such as the gun described in U.S. Pat. No. 3,895,253 dated July 15, 1975.

In a delta gun arrangement, all guns are axially inclined to aid free fall convergence at the center of the shadow mask. In an in-line arrangement only the outer electron guns are canted to assist in the free fall convergence of the three beams. In both arrangements, external magnetic apparatus is still required to make minor adjustments necessitated by normal tolerances. In the delta arrangements, a magnet is used to move the center beam (usually blue) laterally to insure that a common static convergence point is obtained. In an in-line arrangement, a static magnetic device is provided for moving all three of the beams in a horizontal direction for producing purity, that is, assuring that the different colored-light-emitting phosphors are only impinged by electrons from their corresponding guns.

In an EFL type in-line gun, positioning of these external magnetic corrector devices (the static/purity device) is critical if the spot size advantages are to be optimized. As with delta gun arrangements the position of the corrector structures on the neck of the picture tube is determined by measuring from a gun element or a portion of the picture tube. Unfortunately, performance can be adversely affected by even minor errors in positioning.

OBJECTS OF THE INVENTION

A principal object of this invention is to provide an improved color television receiver.

Another object of this invention is to provide an improved static convergence arrangement for a color television receiver.

SUMMARY OF THE INVENTION

In accordance with the invention, a static/purity device includes magnetic means for producing magnetic fields in the vicinity of the elements of an in-line cluster of electron guns located in the neck of a color picture tube. The tube has a connecting base, defining a reference surface for the elements of the guns, and a printed circuit board to which is mounted the picture tube socket. A carrier for the magnetic means encircles the picture tube neck and has a pair of legs engageable with the printed circuit board for assuring correct positioning of the static/purity device on the tube neck with respect to the reference surface.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
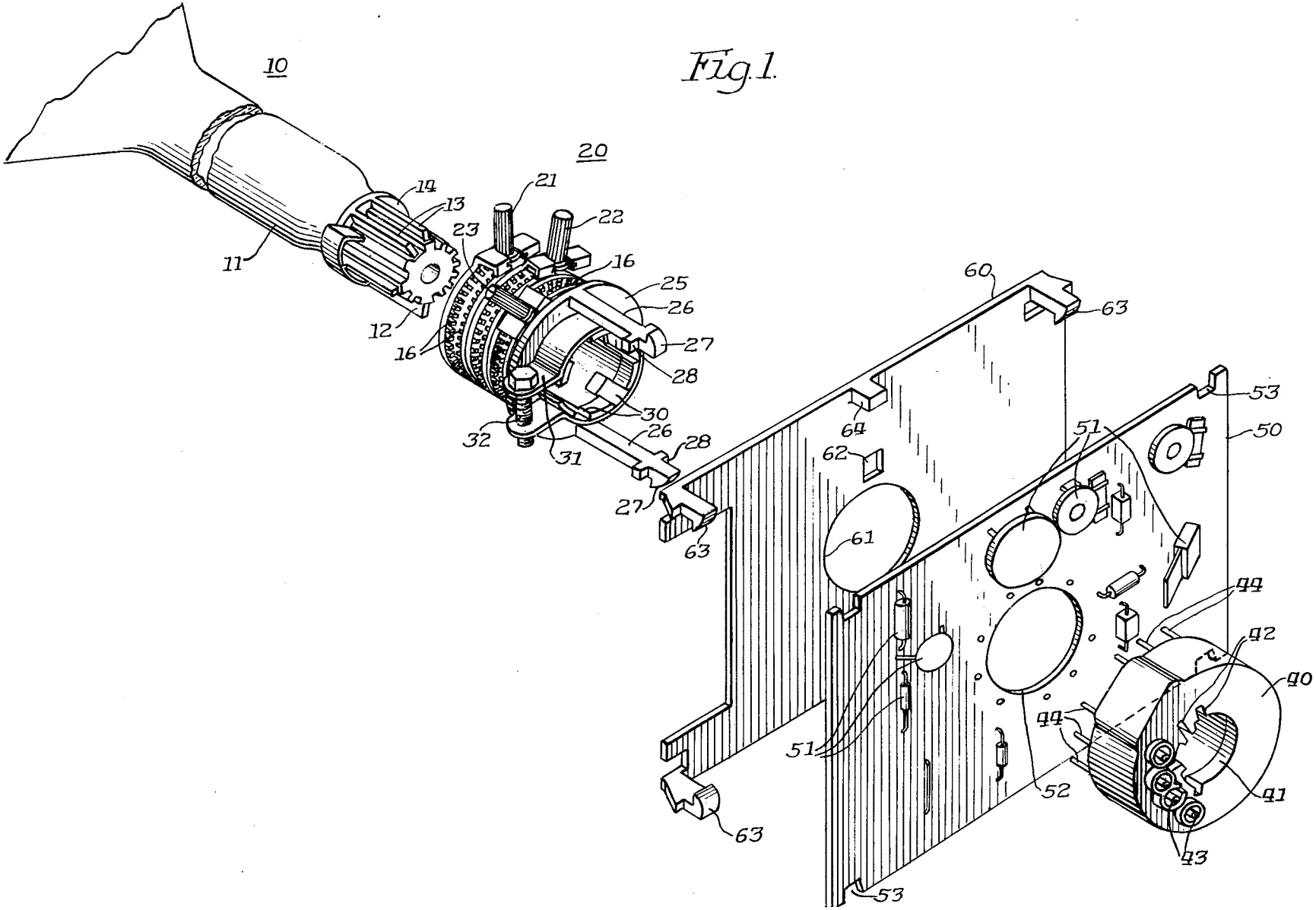
FIG. 1 is an exploded partial view of a portion of a picture tube and socket used with the static/purity device of the invention.

In FIG. 1, a portion of picture tube 10 has a neck 11 terminating in a connecting base 12. An electron gun assembly (not shown) is located in neck 11 and includes a plurality of connecting leads extending through the bottom portion of the picture tube in glass-to-metal seals. The leads are held in fixed position and connections made thereto by a socket engaging base 12. The base generally comprises a rigid molded phenolic material cemented to the bottom of the picture tube and has a plurality of radially disposed keys or barriers 13 about its periphery. The keys cooperate with keyways in a mating picture tube socket to insure a unique position for proper connections between the base leads and socket connectors. Base 12 also includes a flat reference surface 14 against which the socket abuts when properly seated.

A static/purity device 20 comprises a bipolar purity control 21, a quadipolar control 22 and a sextipolar control 23. The denominations, bipolar, quadipolar and sextipolar refer to the type of magnet structure therein. Each control includes a drive gear 15 (FIG. 2) and a pair of facing ring gears 16 respectively driven thereby. Each ring gear is fabricated on the periphery of a thin annular plastic barium ferrite material having the appropriate number of magnetic poles formed therein for producing corrective magnetic fields for the beams from the in-line guns.

A carriage 25 rigidly supports purity control 21 at its forward end, whereas the quadipolar and sextipolar controls are supported for rotational movement about the carriage and hence about the tube neck. A pair of integrally formed legs 26 in carriage 25 terminate in cam surfaces 27 and stops 28. A plurality of spaced flanges 30 are formed at the rearward end of carriage 25. The flanges are encircled by a non-magnetic metallic clamp 31 which, when tightened, presses the flanges against the tube neck to secure the static/purity device against movement. A non-magnetic screw 32 is provided for tightening the clamp. As will be seen tightening of clamp 31 also secures the tube socket in position on base 12.

A picture tube socket 40 includes a generally circular hole 41 for base 12 and a plurality of keyways 42 formed and position for cooperation with respective ones of the keys in the picture tube base. The socket has a number of connecting pins 44 engaging mating apertures in a printed circuit board 50. Socket 40 also includes four rearwardly extending pins 43. These pins are used in the above-mentioned EFL type electron gun to supply the high operating potentials required by certain of the gun elements and the spark gap ground returns. These potentials and spark gap ground returns are supplied through a separate insulating cable, not shown, which fits over pins 43.

Rectangularly shaped printed circuit board 50 has a notch 53 located at each corner. A plurality of electrical components 51 are mounted on one side of the board and connected to an electrical foil pattern (not shown) on the other side for completing electrical connections between the components and the picture tube socket. A clearance hole 52 enables the board to fit over the picture tube neck.

A rigid plastic cover 60, of generally the same configuration as the printed circuit board, has spacer locks 63 at each corner engaging respective notches 53 on board 50. The cover also includes a pair of standoffs 64 (only one shown) which hold a substantially parallel relationship between the cover and the board. A clearance hole 61 overlies clearance hole 52 in the board and is also adapted to fit over neck 11. The cover also includes a pair of mounting holes 62 (one shown in this figure), for engagement with the cams and stops of legs 26 of the static/purity device. When fully assembled, socket 40, board 50, cover 60 and static/purity device 20 are movable as a single unit.

Figure 2:
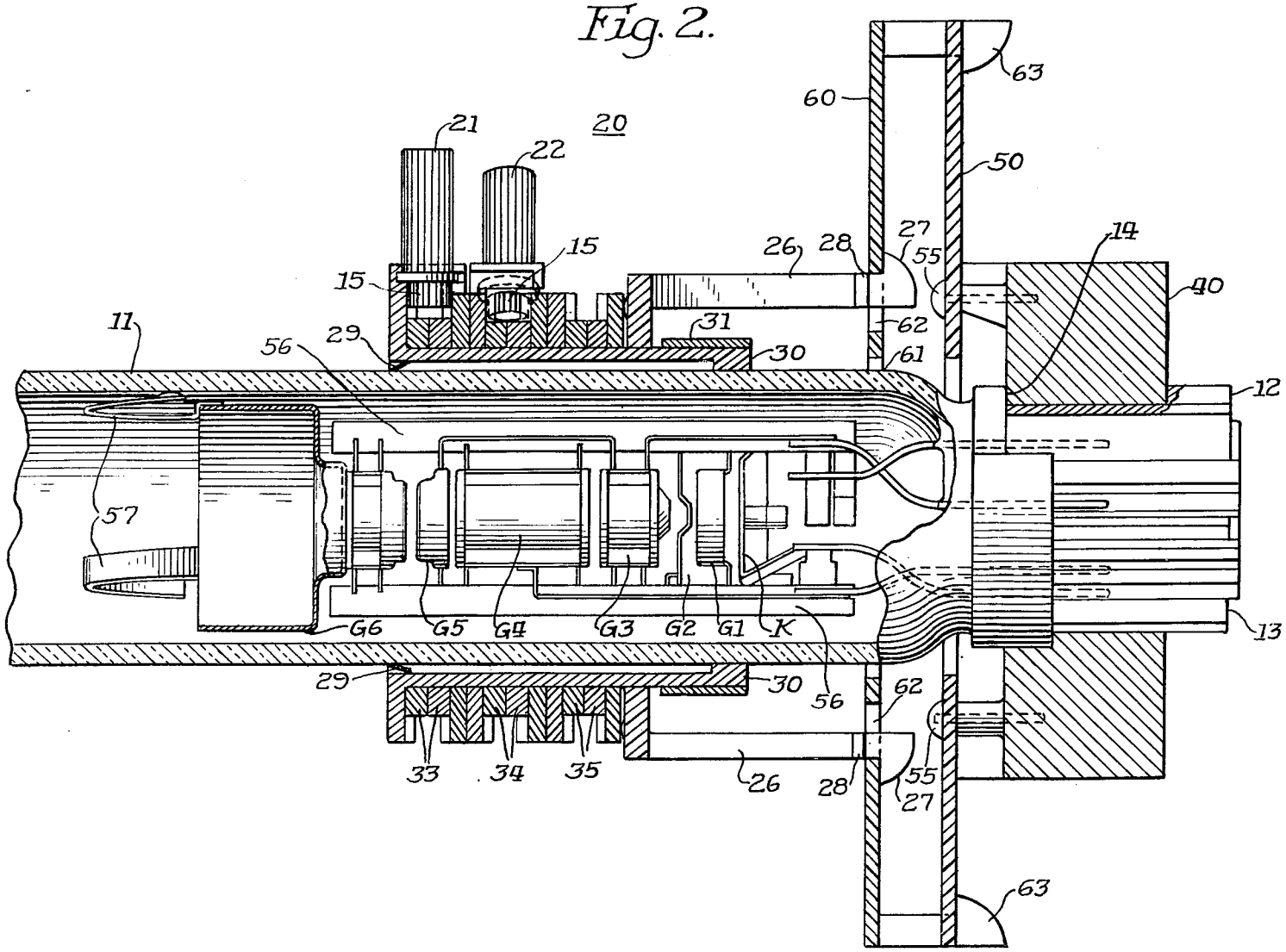
FIG. 2 is an enlarged partially sectioned view of the picture tube neck, socket and static/purity device.

In FIG. 2 an in-line electron gun of the EFL type is positioned in the neck of the picture tube. While not shown, it is standard practice to apply the picture tube anode voltage to a button-type connector on the side of the picture tube funnel which connects to an internal conductive coating on the funnel and a portion of the neck. The last element of the electron gun has a plurality of positioning springs 57 which also make contact with the conductive coating. Thus the anode voltage is supplied to the appropriate electron gun element. In the EFL gun shown the element is called the G6 or anode electrodes and operates at the picture tube high voltage of approximately 30 KV. The next electrode (G5) is spaced from G6 and operates at approximately 12 KV. Similarly, the G4 electrode operates at approximately 7 KV. The G3 electrode is connected internally to the G5 electrode and is, therefore, at 12 KV. The G2 electrode is at approximately 900 volts. The G1 electrode is at approximately 50 volts. The separate cathode electrodes K are supplied with video and color signal voltage information.

A pair of parallel conventional glass multiforms 56 support the electron gun elements in the desired spaced relationship with each other and with respect to the other guns. The gun elements are electrically connected to appropriate pins on base 12 by internal connecting elements, some of which are omitted for clarity.

Static/purity device 20 is shown in proper position on neck 11 over the gun elements. Compression of clamp 31 has forced flanges 30 against the neck of the tube, thus securing the assembly. The forward end of carriage 25 is maintained in proper axial alignment by a plurality of resilient spacers 29, on the inner surface thereof, engaging the picture tube neck. The barium ferrite annular magnets in each control are shown in cross section. Magnets 33 have two poles, magnets 34 have four poles and magnets 35 have six poles. Each magnet pair is carried by a respective ring gear 16 each pair of which is driven in opposite rotational directions by end gears 15.

Cams 27 and stops 28 of legs 26 engage cover 60 through mounting holes 62 with stops 28 abutting the cover surface. Spacer locks 63 maintain the cover in fixed spatial position with respect to printed circuit board 50. Picture tube socket 40 is mounted on circuit board 50 (soldered thereto at solder points 55) and abuts reference surface 14 on tube base 12. Thus the static/purity device is automatically spaced a predetermined distance from reference surface 14 in a particular attitude with respect to the gun upon placement of the picture tube socket on the picture tube base.

During manufacture of a color television picture tube, the gun structure is separately assembled in an appropriate fixture and the elements maintained in proper alignment by sealing their support tabs into the glass multiforms. A glass base or stem, including a tubulator (not shown), having connecting leads sealed thereon is precisely fitted to the bottom of the gun assembly in a fixture. The tubulator is a hollow glass tube through which the picture tube is put under vacuum.

The gun assembly elements are connected by spot welding to the connecting leads which makes the entire assembly substantially self-supporting. The gun assembly is placed in another fixture and inserted in the neck of a picture tube and a glass-to-glass seal formed between the glass base and the picture tube neck. The tube is pumped to vacuum and the tubulator sealed off. The base is then cemented into position.

The base is designed to mate against the glass base in a precise relationship and thus defines a fixed reference point for the elements of the gun. Consequently, when the tube socket is positioned in abutting relationship to this reference surface, magnetic fields produced by the static/purity device are in proper alignment with respect to the electron gun elements. This is accomplished by the combined effect of reference surface 14, socket 40, circuit board 50, cover 60 and legs 26. Heretofore a service technician measured a predetermined distance from the picture tube socket in positioning the static/purity device. With the invention this is accomplished automatically.

The in-line gun cluster and vertical phosphor striped tube screen requires adjustment of the purity control in the horizontal direction only. Therefore, the purity control 21 is not free to move on carriage 25, and cannot be rotated about the longitudinal axis of the picture tube as can the quadipolar and sextipolar convergence controls 22 and 23. Previously the service technician "lined up" the purity control by eye to achieve proper orientation of the static/purity device over the electron guns. With the static/purity device of the invention this is also accomplished automatically upon connection of the socket to the base of the picture tube. Thus the technician need merely take the socket, circuit board and static/purity assembly as a unit and place them over the picture tube neck and firmly seat the picture tube socket against the reference surface of the tube base. Thereafter, the screw on the clamp is tightened to secure the entire assembly on the picture tube neck and the static/purity magnetic structures are in proper position for making corrective beam adjustments.

A further, not insubstantial advantage, is evident at this point. Since the socket and circuit component bearing printed circuit board have a fairly significant mass, they are prone to being dislodged during shipment of the receiver. The locking arrangement of the invention, through the medium of the clamp and screw, retains the socket and board assembly and obviates this problem.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. In a color television receiver, a static/purity device for use on the neck of a color picture tube having a cluster of in-line electron guns located in said neck, and having a connecting base at the closed end of said neck making internal connections to said guns and forming a reference surface for the elements of said guns, said receiver including a printed circuit board having a foil side, and an electrical component carrying side, and a socket for making external electrical connections to said guns, mounted in fixed relationship to said board, said socket thereby being engageable with said base in fixed relationship with said reference surface, comprising: magnetic means producing corrective magnetic fields in the vicinity of said elements for compensating free fall beam landing errors in said tube, and a carrier for said magnetic means, having an integral pair of legs for positioning said carrier with respect to said board for assuring correct positioning of said purity device on said tube neck with respect to said reference surface for aligning said magnetic means with said gun elements.

2. A static/purity device as set forth in claim 1, wherein said foil side faces said static/purity device; further including a cover attached to and covering the foil side of said board, said cover defining an aperture through which said tube neck passes and a pair of mounting holes in engagement with said legs.

3. A static/purity device as set forth in claim 2, wherein said legs include end means for releasably captivating them in fixed positions in said mounting holes.

4. A static/purity device as set forth in claim 3, wherein said end means comprise a cam surface and a displaced stop, said cam surface facilitating engagement in said mounting holes and said stop positioning said carriage from the surface of said cover.

5. A static/purity device as set forth in claim 4, wherein said cam surface includes an angled extension for securely captivating said cover between said extension and said stop.

6. A static/purity device as set forth in claim 5, wherein said magnetic means comprise two pairs of relatively movable disc magnets rotatable about said neck and one pair of relatively movable, non-rotatable disc magnets.

* * * * *